United States Patent [19]

Maier

[11] 4,322,921

[45] Apr. 6, 1982

[54] ECCENTRIC PLATE GRINDER

[76] Inventor: Peter Maier, Gerokstrasse 1, 7311 Neidlingen/Teck, Fed. Rep. of Germany

[21] Appl. No.: 186,771

[22] Filed: Sep. 12, 1980

[30] Foreign Application Priority Data

Sep. 25, 1979 [DE] Fed. Rep. of Germany ..... 2938704

[51] Int. Cl.[3] ..... B24B 23/00

[52] U.S. Cl. ..... 5/170 MT

[58] Field of Search ..... 51/170 R, 170 MT, 170 TL, 51/120; 15/49 R, 50 R

[56] References Cited

U.S. PATENT DOCUMENTS 3,205,622 9/1965 Leveque ..... 51/170 R
3,287,859 11/1966 Leveque ..... 51/120
3,857,206 12/1974 Heffran, Jr. ..... 51/170 MT

*Primary Examiner*—Roscoe V. Parker
*Attorney, Agent, or Firm*—Blanchard, Flynn, Thiel, Boutell & Tanis

[57] ABSTRACT

An eccentric plate grinder has a housing, a driving shaft with an eccentric at one end and a grinding plate, on which abrasive paper is fixed, powered by the eccentric. The grinding plate and the driving shaft are joined together by way of a transmission so that the path of any given grain of abrasive material on the grinding plate will be cycloidal and not in a simple circle.

6 Claims, 1 Drawing Figure

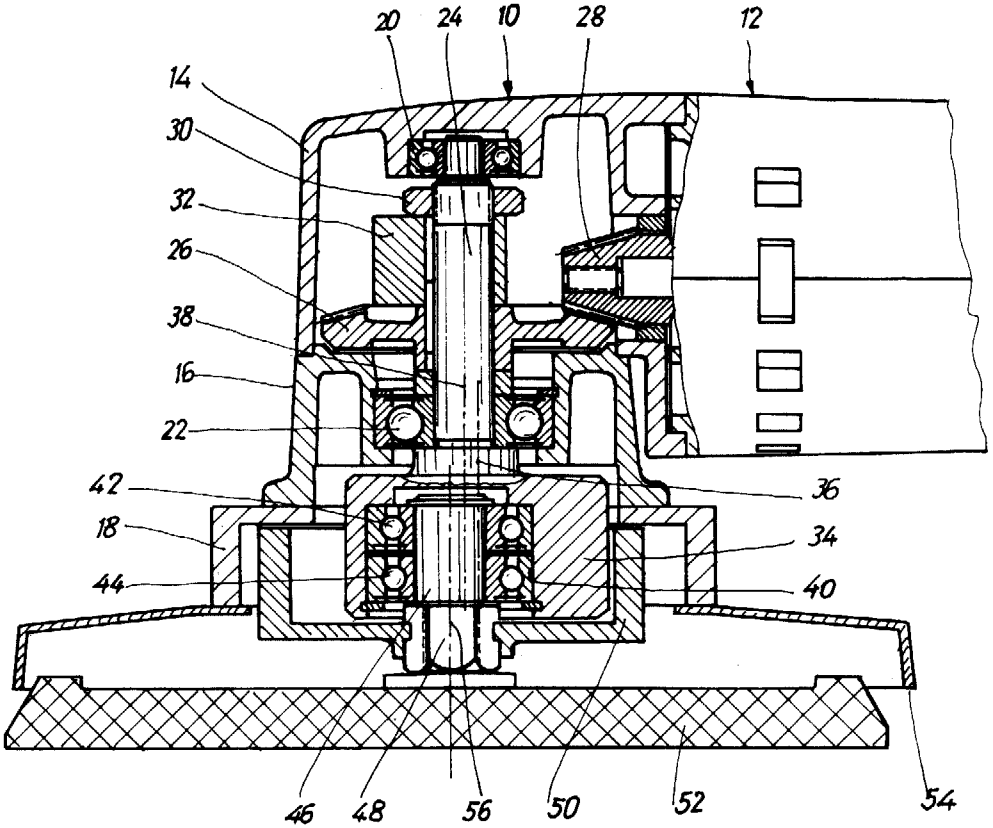
12
28
10
24
20
14
30
32
26
38
16
22
42
18
44
36
34
40
54
52
50
56
48
46

ECCENTRIC PLATE GRINDER

BACKGROUND OF THE INVENTION (i) Field to which the invention relates

The present invention relates to an eccentric plate grinder having a housing, a driving shaft bearinged in the housing, an eccentric supported on one end of the driving shaft, and a grinding plate powered by way of the eccentric.

(ii) The prior art

As presently marketed, such plate grinders have a grinding plate which may be freely turned on the eccentric of the driving shaft so that the center point of the grinding plate is moved in a circle about the axis of the driving shaft. Turning of the grinding plate about its own axis in addition is produced by a friction clutch in the bearing by unsymmetrical loading of the grinding plate when used for grinding operations.

In the case of such prior art eccentric plate grinding machines, the grains of the abrasive paper are moved in circles as well so that each grain will be kept within the groove produced by it on moving over the workface so that there is still room for design development to get a better grinding effect (in addition to simply increasing the grinding speed, which is responsible for troubles in connection with drawing off the dust produced by the abrasive process).

SHORT OUTLINE OF THE PRESENT INVENTION

One purpose of the present invention is that of making such a design of eccentric plate grinder having a housing, a driving shaft bearinged in the housing, an eccentric supported on one end of the driving shaft, and a grinding plate powered by way of the eccentric, that grinding may be undertaken more quickly without increasing the speed of the grinding plate.

For effecting this and other purposes, the grinding plate and the driving shaft are joined up by way of a transmission or gearing.

In a plate grinder of the present invention, the grinding plate is furthermore turned positively in addition about its own axis, this making certain that each and every abrasive grain will be run over a new part of the workface, even if the grinding machine is not moved, so that each time the plate is turned, the greatest possible amount of material will be machined away by the grinding process, this furthermore being possible without any increase in the driving power of the motor being needed.

A further useful effect of the eccentric plate grinder of the present invention is that the grinding process becomes more even, this being more specially important in the case of coarse abrasive paper, because of the abrasive grains' not producing any deep grooves in the workface. For this reason, after-processing with finer abrasive paper may be undertaken more quickly.

The transmission may be made up of a male gear ring, supported on the driving shaft, and a female gear ring, joined up with the grinding plate, and having a greater number of teeth than the male gear ring, such a design being simple, sturdy and trouble-free. Furthermore, such a transmission takes up but little space, it only increasing the overall size of the plate grinder to a very small degree.

As part of a further development of the invention, one of the gear rings has an even number of teeth and the other has an odd number of teeth, this making certain that a long time is taken before one abrasive grain is moved along exactly the same path again on the workface.

The female gear ring may take the form of a bell-like part with the male gear ring within it, this making certain that the teeth of the transmission are kept clear of abrasive dust or particles from the grinding process by the female gear ring itself acting as a cover.

In a further development of the invention, at least one of the gear rings is made of synthetic resin, this decreasing the price of producing the grinder, while, on the other hand, making certain of good running properties, even without lubricant, and of a low noise level.

DETAILED ACCOUNT OF ONE WORKING EXAMPLE OF THE INVENTION

An account of the invention will now be given, making use of the FIGURE, which is an axial section through the head of an eccentric plate grinder.

In the FIGURE the head of an eccentric plate grinder is generally numbered 10 and it is joined to a motor casing generally referenced 12, housing an electric or air-powered driving motor, not detailed in the FIGURE.

Head 10 has, for its part, a housing, made up of three housing parts 14, 16 and 18, put together in this order. The top-most housing part 14 and the middle housing part 16 have, in each case, a ball bearing 20 and 22, supporting a driving shaft 24 on which there is keyed a bevel gearwheel 26, meshing with a bevel pinion 28 bearinged in the sidewall (to be seen on the right in the drawing) of the topmost housing part 14 and keyed on the output shaft of the driving motor (placed in motor casing 12) of the plate grinder.

Between the top side of the bevel gearwheel 26 and the lower side of a threaded ring or nut 30, there is a balancing weight 32 fixed in position for static balancing of a male gear ring 34 at the lower cantilever end of the driving shaft 24 and made in one piece therewith. The axis, numbered 36 in the FIGURE, of male gear ring 34 is at a distance form the axis 38 of driving shaft 24. At the same center distance from the axis 38, a downwardly open blind hole 40 is made in the male gear ring 34, this blind hole having within it two ball bearings 42 and 44 turningly supporting a short or stub shaft 46 which has a head 48 with six flats. Head 48 is keyingly joined with a bell-like female gear ring 50, which is furthermore locked in an axial direction. Female gear ring 50 has a greater pitch circle radius than the male gear ring 34 or, putting it differently, has a greater number of teeth than male gear ring 34 with which it is meshed. The lower end of short shaft 46 is fixedly joined with a grinding plate 52, on which a round piece of abrasive paper is mechanically gripped or glued.

The lower housing part 18 is placed round the female gear ring 50 with a spacing between it and the outer face of ring 50 so that the ring 50 may be eccentrically turned about the axis of driving shaft 24. The ring space between the bell-like female gear ring 50 and the lower housing part 18 is joined up with a dust draw-off opening (not detailed in the FIGURE) through the housing. At the lower end face of housing part 18, a shielding and dust draw-off cover 54 is fixed, which is placed round the grinding plate 52 with play between the two of them at all positions, so that the grinding plate may be eccentrically turned within the cover without anything in its way.

ACCOUNT OF OPERATION OF ECCENTRIC PLATE GRINDER

On the driving shaft 24 being turned by way of the bevel pinion 28 and the bevel wheel 26, the axis numbered 56 of the blind hole 40 and, for this reason, of the grinding plate 52, will be turned or moved in a circle about axis 38 of the driving shaft. Because on this turning motion, the female gear ring 50 will be rolled along on the male gear ring 34, and grinding plate 52 will be turned in addition about its own axis 56. For this reason, the path of a grain in the abrasive paper will be the outcome of mixing two circular motions (cycloidal motion) and will not be a true, simple circle; it is only after a number of turns (dependent on the transmission ratio between the male gear ring and the female gear ring) of the grinding plate, that such a grain will come back into the same path again. This number of turns is, however, very great if the number of teeth of the male gear ring is made great and the difference between the numbers of teeth on the male gear ring and the female gear ring is made low. However, there is a lower limit for the number of teeth on the male gear ring, because otherwise the eccentricity of the path of the grinding plate will be overly low.

If the transmission ratio of the transmission formed by the male gear ring 34 and the female gear ring 50 is made to be equal to 8.6, the grinding plate will make one turn in exactly 8.6 eccentric motions. In this case, a given grain on the abrasive paper will only get back to the same path after 43 eccentric motions, that is to say after five full turns of the grinding plate, this being so, however, only if the plate grinder is not moved bodily. In general use, however, it will be moved by hand over the workface.

In the case of the given design of the invention, the female gear ring 50 has a pitch circle diameter of 72 mm, 48 teeth and a tooth height of 3 mm, while the male gear ring 34 has a pitch circle diameter of 64.5 mm, 43 teeth and a tooth height of 3 mm.

While the male gear ring 34 is best made in a single piece with the driving shaft 24, that is to say is made of the same material, the inner gear ring 50 is best made of injection molded synthetic resin with good dry running properties.

It will clearly be seen from the account given that, by causing motion of the abrasive grains along a cycloidal path, a very much better, that is to say quicker, grinding of material from the workface will be possible, because the grinding grains are kept moving on new paths all the time as they go over the face of the work. This, however, is possible while hardly making the grinder more complex than prior art grinders; the plate grinder has, like prior art grinders, a small size and trouble-free operation may take place for a long time. Because of the cycloidal path of the abrasive grains, there is no danger of one abrasive grain being moved along the same path of the workface and so producing deep grooves. In fact, with the plate grinder of the invention one abrasive grain is in effect moved along a ring-like zone so that an even grinding effect on the workface is produced.

I claim:

1. An eccentric plate grinder comprising:

a housing;

a drive shaft rotatably supported in said housing;

a grinding plate to be moved in a cycloidal path;

a male gear ring;

a female gear ring fixed to the grinding plate and driven by said male gear ring, the female gear ring having a greater number of teeth than the male gear ring, said male gear ring being fixed eccentrically to said drive shaft for rotation with said drive shaft and with respect to said housing and grinding plate, said male and female gear rings both being movable with respect to said housing.

2. In an eccentric plate grinder comprising:

a housing;

a drive shaft supported in said housing;

a cylinderlike eccentric carried at one end of said drive shaft;

a grinding plate driven from the drive shaft by transmission means including the eccentric and a female gear ring and a male gear ring to achieve a cycloid-like movement;

wherein the improvement is comprised in that the free end of the eccentric has an eccentric blind hole, a stub shaft rotatably supported in said blind hole, said grinding plate being fixed to said stub shaft for rotation therewith, said stub shaft being connected with the female gear ring, said female gear ring surrounding the eccentric, the eccentric being constructed as said male gear ring, the axes of the male gear ring and blind hole being fixed diametrally opposite to one another with respect to the axis of the drive shaft.

3. A plate grinder according to claim 2, wherein one of the gear rings has an even number of teeth and the other gear ring has an uneven number of teeth.

4. A plate grinder according to claim 2, wherein the female gear ring is a bell-shaped part, in which the male gear ring is received.

5. A plate grinder according to claim 2, wherein at least one of the gear rings is made of synthetic resin.

6. A plate grinder according to claim 2 in which the axis of said eccentric is the axis of said male gear ring, the drive shaft being noncoaxial with both of said gear rings.

* * * * *